United States Patent [19]

Sonneville

[11] 3,948,010

[45] Apr. 6, 1976

[54] REINFORCING DEVICE FOR AN ELEMENT OF PRESTRESSED CONCRETE

[76] Inventor: Roger Paul Sonneville, 5, rue Maurice Ravel, 92 Saint-Cloud, France

[22] Filed: Nov. 18, 1974

[21] Appl. No.: 524,942

Related U.S. Application Data

[63] Continuation of Ser. No. 312,413, Dec. 5, 1972, abandoned.

[30] Foreign Application Priority Data

Dec. 17, 1971 France ..... 71.45425
May 4, 1972 France ..... 72.15842

[52] U.S. Cl. ..... 52/223 R; 52/230; 238/85; 238/115

[51] Int. Cl.[2] ..... E04C 5/08

[58] Field of Search ..... 52/223 R, 230, 309, 732; 238/115, 116, 84, 85, 91

[56] References Cited

UNITED STATES PATENTS

| | | | |
|---|---|---|---|
| 1,227,345 | 5/1917 | Tonn | 238/116 |
| 1,302,293 | 4/1919 | Blazer | 52/223 R |
| 2,303,394 | 12/1942 | Schorer | 52/723 X |
| 2,378,584 | 6/1945 | Schorer | 52/230 |
| 2,453,079 | 11/1948 | Rossman | 52/233 R |
| 2,857,755 | 10/1958 | Werth | 52/723 X |
| 2,963,273 | 12/1960 | Lane | 52/223 R |
| 3,119,203 | 1/1964 | Frsterwalder | 52/223 L |
| 3,307,310 | 3/1967 | Kourkene | 52/230 |
| 3,313,560 | 4/1967 | Macchi | 52/230 X |
| 3,533,203 | 10/1970 | Fisher et al. | 52/309 X |
| 3,605,364 | 9/1971 | Ford | 52/223 R X |
| 3,676,968 | 7/1972 | Campbell | 52/230 X |

FOREIGN PATENTS OR APPLICATIONS

| | | | |
|---|---|---|---|
| 452,126 | 11/1934 | United Kingdom | 52/230 |
| 78,223 | 5/1962 | France | 52/223 |
| 299,629 | 6/1954 | Switzerland | 52/230 |
| 1,288,878 | 2/1961 | France | 52/223 |
| 522,510 | 3/1931 | Germany | 52/223 |
| 815,128 | 6/1959 | United Kingdom | 238/85 |
| 672,336 | 10/1963 | Canada | 52/230 |
| 156,135 | 2/1953 | Australia | 238/91 |
| 497,241 | 9/1954 | Italy | 238/85 |
| 1,047,105 | 12/1953 | France | 238/85 |

*Primary Examiner*—Frank L. Abbott
*Assistant Examiner*—Leslie A. Braun
*Attorney, Agent, or Firm*—Wenderoth, Lind & Ponack

[57] ABSTRACT

The invention relates to the technique of prestressed concrete and concerns a reinforcing device comprising a cylindrical metal tube at the ends of which are friction welded two plates or flanges defining radial support surfaces for bearing on the concrete. One of these plates constitutes an end wall against which abuts a metal core for putting the tube under tension. The other plate, which has a centre aperture, comprises means such as screw threading which cooperates with a bolt for achieving said tensioning in an effective and easy manner. Preferably, the tube has a section which varies along its longitudinal axis so as to afford an improved guide for the core and improve the characteristics of the reinforcement. A particularly advantageous application is in the manufacture of composite railway ties.

17 Claims, 12 Drawing Figures

REINFORCING DEVICE FOR AN ELEMENT OF PRESTRESSED CONCRETE

This is a continuation of application Ser. No. 312,413,filed Dec. 5, 1972, now abandoned.

BACKGROUND OF THE INVENTION

The present invention relates to the technique of prestressed concrete and more particularly concerns reinforcements and devices for effecting a pretension for the mass-production of prestressed concrete elements. It also relates to such elements and in particular railway sleepers or ties.

Many reinforcing and pretension devices are known of the type comprising: an outer tube constituting the reinforcement proper closed at one end and open at the other; an inner core received in the tube; and means for putting under tension disposed at the open end of the tube and co-operating with the open end and the adjacent end of the core for establishing and maintaining between the tube and core an axial force of given value. Such arrangements are described in French Pat. No. 1,288,878, the first Addition No. 78,223 to French Pat. No. 1,263,984 and the German Pat. No. 522,510.

The first of these references provides means for putting the tube under tension which either weaken the tube in that they require it to be screwthreaded at both ends or are relatively elaborate and do not lend themselves to a profitable production on an industrial scale.

The two other references relate to two structures which employ for the core a material such as sand, mortar or concrete whose use does not lend itself well to mass-production and which does not permit obtaining characteristics that are idential from one element to another.

SUMMARY OF THE INVENTION

An object of the present invention is to overcome these various drawbacks and to provide a reinforcing device whose manufacture and utilization lend themselves particularly well to industrial mass-production and whose performances are substantially improved so that the characteristics of the concrete element in which they are incorporated are also improved.

These results are obtained in a reinforcing device of the type comprising a rigid tube and support surfaces extending roughly radially from the outer surface of the tube, by providing end plates or flanges which define the support surfaces and are secured to the end of the tube, one of the plates defining also an end wall whereas the other is provided with a centre aperture and includes means for putting the reinforcement under tension.

Other important features of the device according to the invention are the following:

the end plates or flanges are friction welded to the ends of the tube;

the tube has a cross-sectional shape which varies along its longitudinal axis.

Another object of the invention is to provide a prestressed reinforced concrete element comprising a reinforcing device such as defined hereinbefore.

A particularly interesting application is in the mass-production of railway sleepers or ties of the composite type, that is, the type comprising two concrete blocks interconnected by a tie member which also acts as a reinforcement in the two blocks. The tie member is then constituted by aa reinforcement according to the invention. Preferably the tube then has, in the regions surrounded by concrete, a cross-sectional shape which is oblong, oval or elliptical, the major dimension of which is roughly horizontal whereas in the free region between the two blocks this section, which is also oblong, oval or elliptical, has its major dimension roughly vertical.

BRIEF DESCRIPTION OF THE DRAWINGS

In a general way, the invention and its advantages will be explained in more detail in the ensuing description with reference to the accompanying drawings, given solely by way of example and in which.

DETAILED DESCRIPTION OF THE INVENTION

Figure 1:
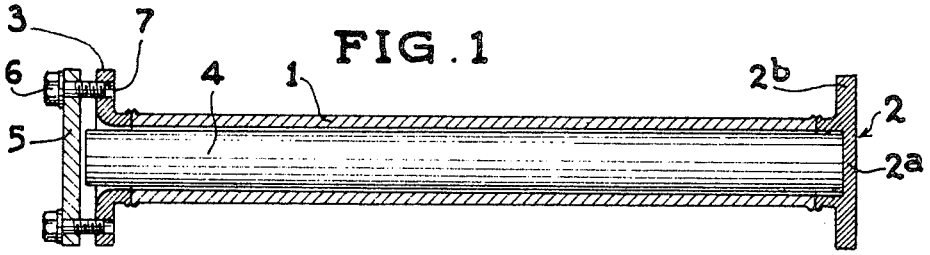
FIG. 1 is a longitudinal sectional view of a reinforcing device according to the invention.

FIG. 1 shows a reinforcing device according to the invention comprising an outer rigid reinforcement unit constituted by a steel tube 1 to the ends of which are secured, for example by friction welding, two plates or flanges 2, 3. The plate 2 defines an unapertured end wall $2^a$ and a flange $2^b$ of larger diameter, and the plate 3, which has a diameter in the neighbourhood of the diameter of the flange $2^b$, is provided in its centre part with an aperture $3^a$ which has roughly the same diameter as the inside diameter of the tube 1. A centre pressure transmitting core 4 is disposed inside the tube and may be tubular or solid and has one end abutting the end wall $2^a$. Secured to the end plate 3 is a clamping plate 5 which may be moved toward the plate 3 by means of bolts 6 which are screwthreadedly engaged in tapped holes provided in the plate 3.

Figure 2:
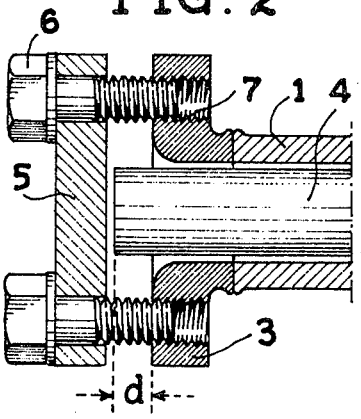
FIG. 2 is a partial sectional view, to an enlarged scale, of one end of this device.

The active end of the device shown in FIG. 1, namely the end at which the plate 3 and the clamping plate 5 are disposed, is shown in detail in FIG. 2.

It will be understood that by tightening the bolts 6 in a progressive and uniform manner, the clamping plate 5 compresses the core 4 at the centre thereof, whereas the distance between the plates 3 and 5 increases under the effect of the elastic deformation under tension of the tube 1 and the corresponding elastic deformation under compression of the core 4. If $d$ designates the extent to which the core 4 extends beyond the end plane of the plate 3 in the free state (FIG. 2), the distance *d* must be chosen in such manner that the correct tension of the tube 1 is obtained when the distance *d* is zero so that this stressing operation may be carried out by unskilled labour. Note that the clearance between the tube 1 and the core 4 is small enough to prevent the buckling or lateral deflection of the core which is subjected to high longitudinal compression, but it is sufficient to enable the core to slide freely inside the tube when it is inserted and subsequently withdrawn from the latter. When this prior tensioning of the tube 1 has been achieved, an assembly is available constituted by the element shown in FIG. 1 which is ready to be placed in position in a mould for the purpose of manufacturing an element of reinforced concrete as will be explained hereinafter in a particular application.

Figure 3:
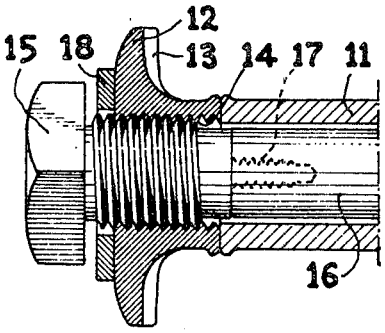
FIG. 3 is a view similar to FIG. 2 of a modification of the device.

There will now be first described two modifications of the reinforcing device shown in FIG. 1. First, in FIG. 3 there is shown the active end of such a device constituted by the end portion of the tube 11 on which is friction welded a stamped-out plate 12 having radial ribs 13 adapted to improve the anchorage thereof in the concrete. This end plate comprises a tapped tubular portion 14 which receives a bolt 15 adapted to exert a compressive force on the centre core 16. The latter has at its end a tapped aperture 17, or an aperture of any suitable shape, to facilitate the extraction of the core when the bolt 15 has been removed. A washer 18 is also provided.

Figure 4:
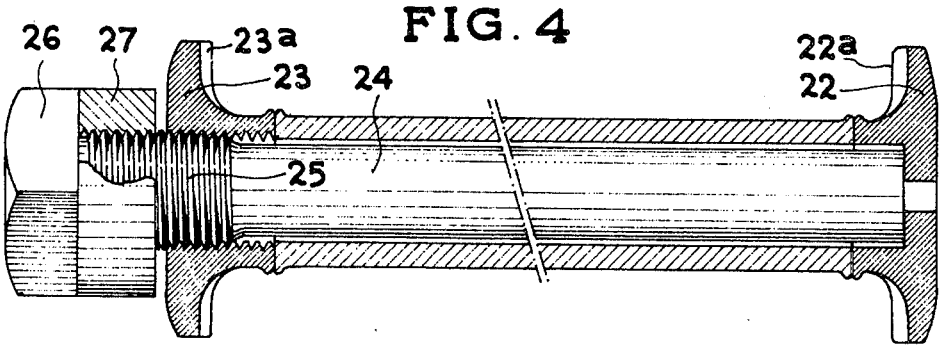
FIG. 4 is a view similar to FIG. 2 of another modification of the device.

In the embodiment shown in FIG. 4, an outer rigid reinforcement unit comprises a tube 21 which has at one end a plate 22 constituting an end wall and provided with ribs $22^a$, and at its other end a second plate 23 also provided with radial ribs $23^a$. These two plates are welded to the tube 21 by friction. Received in the tube is a centre pressure transmitting core 24 having at the end thereof in the vicinity of the plate 23 an enlargement 25 which is screwthreaded and adapted to co-operate with the inner tapped portion of the plate 23. This core terminates in a head portion 26 similar to that of a bolt and a spacer collar 27 may be interposed between this head portion and the outer surface of this plate 23, for example to determine with precision the distance to which the core must be screwed into the tube to obtain the desired tensile force.

In these two embodiments, the tensioning of the tube may be achieved by screwing by means of a rotary hydraulic jack or shifting device, the tensile force being measured by the direct measurement of the tightening torque or of the extent to which the bolt is screwed into the end plate.

Figure 6:
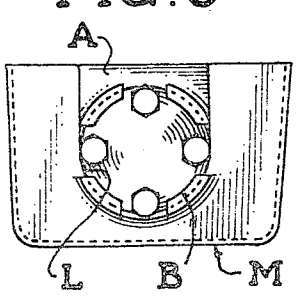
FIGS. 5 and 6 are respectively a longitudinal sectional view and an end elevational view of a concrete sleeper or tie including a reinforcing device according to the invention.
Figure 5:
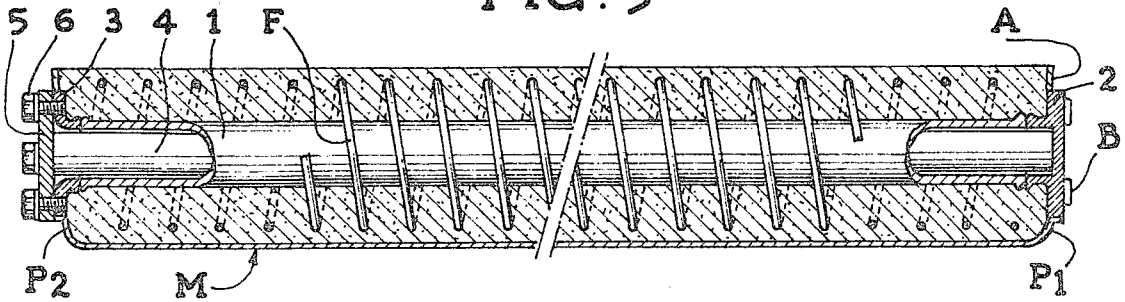

There will now be described with reference to FIGS. 5 and 6 an application of the invention to the construction of a beam of prestressed concrete such as a railway sleeper or tie. FIG. 5 shows a mould M in the shape of a trough in which is placed a prestressing reinforcing device such as that described with reference to FIGS. 1 and 2. The rigid reinforcement is disposed between the end walls $p^1$, $p^2$ of the mould in which are formed cavities L for receiving the end plates 2 and 3. In referring to FIG. 6 it can be seen that the mould M is completed at both ends by detachable members A which ensure a seal above and around the plates 2 and 3 and contribute to the maintenance of the reinforcement in the mould during the consequent vibration stage. Means B may also be provided for facilitating the centering of the reinforcement in the mould. When the reinforcement is placed in position in the mould, the tube 1 is under tension by a prior tightening of the bolts 6. Spiral binding hoops or bands F of hard steel are moreover disposed around the tubular reinforcement to reinforce the concrete against outward radial forces which are exerted thereon when it undergoes the prestressing. With the reinforcement in position, the mould M is filled with concrete and then vibrated and compressed. Stripping from the mould may be carried out immediately so that an automatic moulding machine may be employed. When the concrete had reached sufficient strength after having stayed for a sufficiently long period in an oven and/or after storage to achieve a natural hardening, the bolts 6 may be unscrewed and the plate 5 removed so that the centre core 4 can be withdrawn from the tube. It will be understood that when the clamping plate 5 and the centre core are removed, the stressing of the tube is transferred to the mass of concrete partly by adherence and partly through the end plates so that the concrete beam is prestressed. It is then sufficient to close the aperture remaining open at one of the ends of the tube after optionally spraying with a protective produce and/or chemically reducing product to preclude internal corrosion of the reinforcement tube. By way of example, it may be mentioned that in the case of a concrete sleeper or tie intended to withstand a final prestressing of 30 metric tons, the reinforcement may be constituted by a tube having an outside diameter of 42 mm and a wall thickness of 3 mm.

Such a prestressing method meets much better than known methods the requirements of modern industrial organisation and mechanisation in particular for the following reasons: the reinforcement may be prepared in a specialized workshop, for example located at the very source of the tubes, which comprises essentially an automatic rotary friction welding machine employing a very modern method which, apart from its cheapness, has the advantage of being extremely rapid and of not impairing the mechanical characteristics of the steels, even if they have been previously heat treated;

the tensioning of the tube by reaction of the inner core is easily localized and easy to control automatically by measuring the force or elastic elongation of the tube;

the functions of support of the core and reception of the clamping means are performed by the end plates or flanges which also ensure the transmission to the concrete of the prestressing force;

as the tube does not have any screwthreading it is not weakened and may have the minimum required thickness for withstanding the estimated stresses in the contemplated application;

the concrete is easily moulded and stripped from the mould by an automatic moulding machine as though it concerned ordinary reinforced concrete;

the concrete may be prestressed merely at the moment when the beam is withdrawn from the stores for dispatch to the place of use, this prestressing merely consisting of releasing the connection between the tube and core with no measurement or control of the force so that no skilled labour is required;

it is unnecessary to stove the concrete and the moulded product may harden naturally in a storage ground during the required period of time, for example 28 days, which reduces the cost of the plants and improves the final qaulity of the concrete;

note in this respect that the material immobilized during the hardening period is of low value, since it is indeed essentially constituted by the reaction bars or cores and the bolts or like devices which may be used again in the following month.

Figure 7:
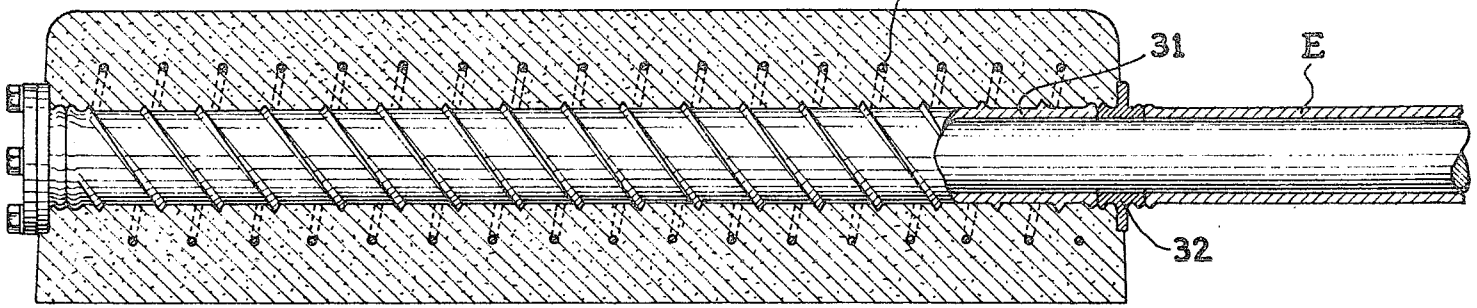
FIG. 7 is a partial sectional view of a composite sleeper or tie to which the device according to the invention is applied.

FIG. 7 shows a part of a composite sleeper or tie constituted by two small concrete blocks interconnected by a tie member E. In this embodiment, the tie member is constituted by a tube 31 whose diameter may be of the order of 60 mm and have a wall thickness of 3.25 mm to possess the required strength, this tube acting in each of the two blocks as a prestressing reinforcement and being pretensioned and placed in position in accordance with the method according to the invention. Bearing in mind that the length of the tube in contact with the concrete is reduced in this case to the length of the block, ridges or other surface unevennesses are also provided on the outer surface of this tube to improve the adherence between the tube and the concrete. There may also be provided flanges, such as 32, which improve the transmission of the compressive forces exerted by the tie member-reinforcement on the concrete. Helical binding bands or hoops 33 are also provided to reinforce the concrete against outward radial forces which are produced when the concrete is prestressed.

Figure 8:
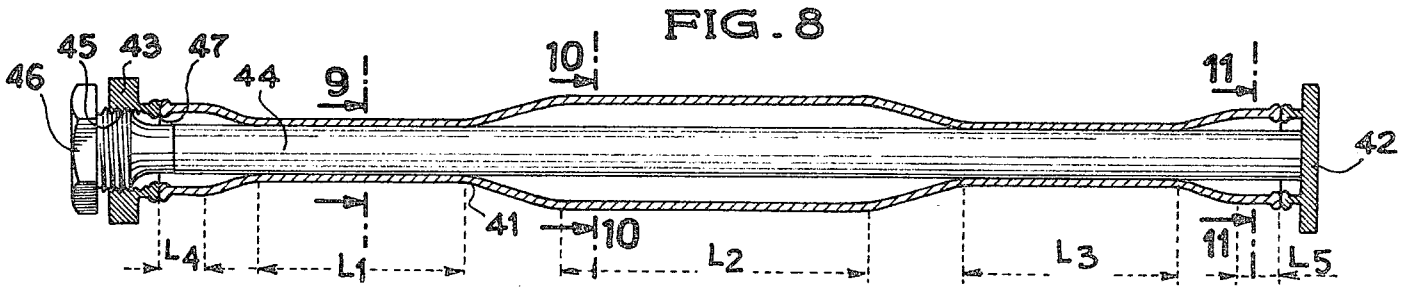
FIG. 8 is a diagrammatic longitudinal sectional view of another embodiment of a reinforcing device according to the invention.

FIG. 8 represents another embodiment of an assembly comprising a rigid reinforcement unit constituted by a tube 41 to which end plates 42, 43 are welded and means for placing this reinforcement in a pretensioned state. These means, which are identical to those provided in the embodiment shown in FIG. 3, comprise a centre pressure transmitting core 44, an internal screwthread 45 provided in the plate or flange 43 and a bolt 46 co-operating with the nut constituted by the plate 43.

Figure 11:
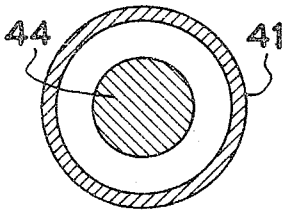
FIGS. 9, 10 and 11 are sectional views, to an enlarged scale, respectively taken on lines 2—2, 3—3 and 4—4 of FIG. 1.
Figure 10:
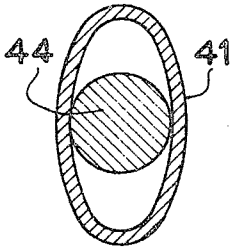
Figure 9:
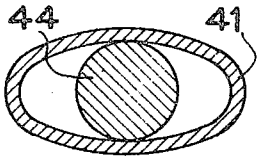

In this embodiment, the tube 41 does not have the same section throughout its length. In the illustrated embodiment, it has three main portions or sections $L^1$, $L^2$, $L^3$, interconnected by transition regions and having oval cross-sectional shapes which have their major axes oriented in different directions. Thus, the portion $L^1$, $L^3$ have a cross section corresponding to that shown in FIG. 9 whose major axis is horizontal (in the position shown in the drawing), whereas in the portion $L^2$ the major axis is angularly offset by 90° and is therefore vertical (FIG. 10). In the vicinity of its free ends, the tube has in two portions $L^4$, $L^5$ a circular cross-sectional shape (FIG. 11) so as to permit the friction welding by rotation of the plates 42, 43. In the non-circular sections the length of the minor axis is chosen to be slightly greater than the diameter of the core 44. The latter has a diameter slightly less than the nominal diameter of the tube and can thus easily pass through the bead 47 which is formed by the friction welding of the plates 42, 43 to the tube.

Preferably, the tube 41 is given the shape shown or some other suitable shape by subjecting it in the cold state to a press operation which exerts a pressure along two diametrally opposed generatrices. This deformation can be effected before or after the welding operation carried out on the plates 42, 43.

This embodiment has the following essential advantages:

possibility of modifying and improving the mechanical characteristics of the reinforcement in accordance with the particular contemplated application;

considerably increased adherence and anchoring in the concrete;

reduced overall size in one direction;

a guiding and a lateral maintenance of the centre core when putting the tube under tension.

Figure 12:
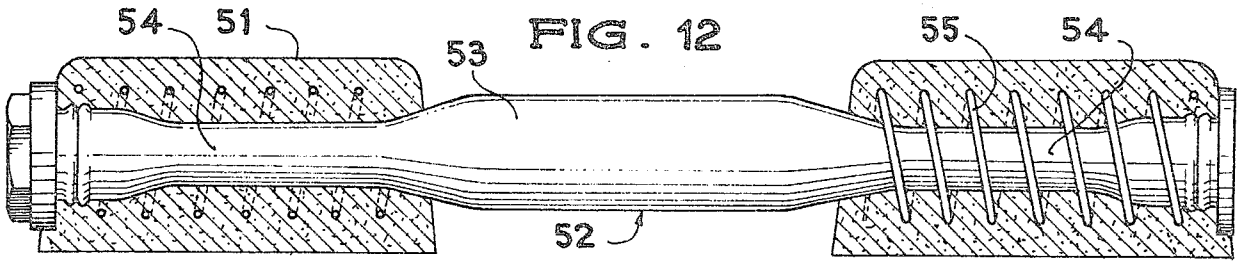
FIG. 12 is a longitudinal sectional view of a composite sleeper or tie for a railway track including an improved reinforcement such as that shown in FIGS. 8–11.

These very important advantages will be more clear after the description of the application of such a reinforcement to a composite sleeper or tie for a railway track which is diagrammatically shown in FIG. 12. This sleeper comprises two small concrete blocks 51 each of which is adapted to support a rail and are connected by a tie member 52 constituted by a tube such as that shown in FIGS. 8–11. In the free part of the tube 53 between the two concrete blocks the tube has an oblong cross-sectional shape whose major axis or longer side is vertical. This portion of vertically deformed tube may extend if desired a certain distance inside the concrete blocks.

In each of the two regions 54 of the tubular reinforcement inside the blocks, the section of the tube is also oblong but the major axis or longer side extends horizontally. In the illustrated embodiments, these flattened regions have a length which is substantially less than that of the block 51. As in the embodiment shown in FIG. 7, the reinforcement tube is surrounded by at least one spiral hooping 55 of hard steel which completes the reinforcement of the block. However, such a hooping is not necessarily essential.

In this particular application, the very substantial advantages afforded by the device according to the invention are the following:

the moment of inertia and the section modulus of the tube with respect to the horizontal axis, characterizing the stiffness in the vertical plane, have been markedly increased by the oval shape which is very cheap to obtain since the operation is carried out in the cold state on the initially circular tube. This deformation thus permits taking advantage still further of the section of the metal of the tube and increasing the stiffness of the tube in the vertical plane which, in the case of the presently-described application, is advantageous for a composite sleeper in which the tube constitutes the tie member;

the change in the section of the tube which results in a very marked deformation in the vicinity of the entrance of each of the blocks 51 permits considerably increasing the adherence and anchorage of the tube in the concrete when the means for putting the tube under tension have been released to subject the concrete to the prestressing;

this anchoring region of the deformed tube in the concrete may be surrounded by a hard steel spiral reinforcement 55, since the deformation of the tube exert increased radially outward forces owing to the increase in the section and the wedge effect in the vicinity of the vertical plane, that is, upwardly and downwardly in the presently-described application;

the flattening of the tube in the region located under the rails inside the blocks 51 permits a reduction in the thickness of these blocks and an increase in their flexibility without having to reduce the thickness of the concrete extending over and under the reinforcement;

the additional anchoring afforded by the change in the section may be put to use to reduce the dimensions of the outer radial flange of the end anchoring plates;

the deformation of the tube by flattening in successively orthogonal directions afford the advantage of reducing the free length of the core for putting under tension which is inserted in the tube and is subjected to a compression which might cause it to buckle or bend at the moment when the tube is put under tension before placing it in the mould;

the deformations of the tube which are judiciously arranged and multiplied, if necessary, enable the rigid reaction core to be guided inside the tube so as to preclude its buckling or lateral deflection notwithstanding the small effective diameter of this core with respect to its total length between the end plates.

By way of a numerical example justifying the interest of this embodiment, a composite sleeper or tie may be constructed with a tubular tie member having an outside diameter of 60 mm and a wall thickness of 3.5 mm.

By deforming this tube in the manner described hereinbefore so as to impart thereto a small inner axis or a minimum section of passage of a little more than 40 mm instead of 53 mm corresponding to the undeformed circular section of the tube, the moment of inertia of the tie member in the centre part thereof uncovered with concrete is increased from 25 $cm^4$ corresponding to a circular tube to more than 33 $cm^4$ for the oval section. The deformation has increased therefore by more than 30 percent the stiffness of the tie member in the desired direction without modifying the weight of the tube.

Likewise, the flattening of the tube under the rails permits, in the presently-described application, a reduction in the thickness of nearly 13 mm while maintaining the same minimum inner sectional passage of 40 mm and with the same layer of concrete above and under the tube.

It is also possible to reduce from 53 to about 40 mm the diameter of the inner reaction core while reducing the risk of buckling or lateral deflection since this core, here guided in three regions, has a free extent considerably reduced with respect to EULER'S formulae for lateral deflection.

The presently-described embodiment of the invention therefore permits taking full advantage of a tubular reinforcement of circular section by deforming it in a judicious manner, so as to modulate the section in accordance with the characteristics to be obtained along the part with minimum weight and volume of high strength steel. The deformations of the cross section of the tube are also employed to increase the anchorage and possibly remedy any insufficient adherence of the concrete to the tube and to guide the inner reaction core inserted in the tube and preclude its buckling, if the part is long with respect to its section, at the moment of putting the tube under tension by compression of the core.

Having now described my invention what I claim as new and desire to secure by Letters Patent is:

1. A reinforcing device for the prestressing by compression of a concrete element and comprising a rigid reinforcement unit having a metal tube and two end plates respectively permanently fixed to opposite ends of the tube, a first of which plates constitutes a first end wall defining a terminal transverse face of the unit whereas a second of said plates constitutes an opposite second end wall defining a terminal transverse face of the unit which second end wall defines an aperture in the extension of the interior of the tube, the first end wall defining an inner face facing the second end wall, means for urging the plates apart and thereby putting the whole of the tube under tension, the plates defining support surfaces which face each other and extend substantially radially outwardly of the tube for compressing the concrete element between the plates when the tube-tensioning means are rendered inoperative, the tube-tensioning means comprising metal pressure-applying means co-operative with the second plate and disposed within the tube and capable of axially abutting said inner face of said first end wall, and screw means interposed between the second plate and the pressure-applying means for urging the pressure-applying means against said inner end face, the pressure-applying means comprising a rigid metal core and being removable from the second plate and removable from the tube by way of said aperture after tensioning of the tube, the tube having in some regions of the tube a cross-sectional shape which has a first dimension in a first direction and a second dimension shorter than the first dimension in a second direction perpendicular to the first direction, the cross-sectional shapes of at least two of said regions of said tube having their first dimensions oriented differently and the second dimensions being but slightly larger than the corresponding dimension of the cross-section of the core so that the tube affords a lateral support for the core against buckling of the core.

2. A reinforcement for the prestressing by compression of a concrete element and comprising a rigid reinforcement unit having a rigid tube and two coaxial end plates respectively fixed to opposite ends of the tube, one of the plates constituting an end wall defining a terminal transverse face of the unit which end wall has an inner face facing the opposite end of the tube and the other plate constituting an apertured end wall defining a terminal transverse face of the unit with the aperture in a centre part of said other plate, said other plate being adapted and arranged to support means for exerting an axial pressure against said inner face through pressure-transmitting means and to allow removal of said pressure-transmitting means from the tube, the tube having in some regions of the tube a cross-sectional shape which has a first dimension in a first direction and a second dimension shorter than the first dimension in a second direction perpendicular to the first direction, the cross-sectional shapes of at least two of said regions of said tube having their first dimensions oriented differently and the second dimensions being but slightly larger than the corresponding dimension of the cross-section of the core so that the tube affords a lateral support for the core against buckling of the core.

3. A reinforcement as claimed in claim 2, wherein each of the two end plates comprises a cylindrical portion having the same diameter as the diameter of the tube.

4. A reinforcement as claimed in claim 2, wherein the end plates include substantially radial ribs on surfaces of the plates which face each other.

5. A reinforcement as claimed in claim 2, wherein the tube has surface unevennesses intermediate the ends of the tube.

6. A reinforcement as claimed in claim 2, wherein said cross-sectional shape is oblong.

7. A reinforcement as claimed in claim 2, wherein said cross-sectional shape is substantially elliptical.

8. A reinforcement as claimed in claim 2, wherein the portions of the tube immediately adjacent the ends of the tube have a circular cross-sectional shape.

9. A reinforcing device for the prestressing by compression of a concrete element and comprising a rigid reinforcement unit having a rigid tube and two end plates respectively fixed to opposite ends of the tube, one of which plates constitutes an end wall defining a terminal transverse face of the unit whereas the other plate constitutes an apertured end wall defining a terminal transverse face of the unit with the aperture in a centre part of the other plate and is combined with means for urging said end plates apart and thereby putting the whole of the reinforcement unit between said plates under tension, said unit tensioning means comprising a rigid pressure-transmitting core within the tube, the plates defining support surfaces which face each other and extend substantially radially of an outer surface of the unit for compressing the concrete between said plates when said unit tensioning means are rendered inoperative, the tube having in some regions of the tube a cross-sectional shape which has a first dimension in a first direction and a second dimension shorter than the first dimension in a second direction perpendicular to the first direction, the cross-sectional shapes of at least two of said regions of said tube having their first dimensions oriented differently and the second dimensions being but slightly larger than the corresponding dimension of the cross-section of the core so that the tube affords a lateral support for the core against buckling of the core.

10. A device as claimed in claim 9, wherein the tube has cylindrical end portions and each of the two end plates comprises a cylindrical portion having the same diameter as the diameter of the tube and the plates are friction welded to the respective end portions of the tube in a plane substantially perpendicular to the axis of the tube.

11. A device as claimed in claim 9, wherein the end plates include substantially radial ribs on said surfaces of the plates which face each other.

12. A device as claimed in claim 9, wherein the tube has surface unevennesses intermediate the ends of the tube.

13. A device as claimed in claim 9, wherein said cross-sectional shape is oblong.

14. A device as claimed in claim 9, wherein said cross-sectional shape is substantially elliptical.

15. A reinforcing device for the prestressing by compression of a concrete element and comprising a rigid reinforcement unit having a rigid tube and two end plates respectively fixed to opposite ends of the tube, one of which plates constitutes an end wall defining a terminal transverse face of the unit, which end wall has a inner face facing the other end of the tube, whereas the other plate constitutes an apertured end wall defining a terminal transverse face of the unit with the aperture in a centre part of the other plate, and means for putting the whole of the reinforcement unit between said plates under tension, the plates defining support surfaces which extend substantially radially of an outer surface of the unit and face each other for compressing the concrete between said plates when said tube-tensioning means are rendered inoperative, said tube-tensioning means comprising a rigid metal core which is disposed within the tube and has a length which is in the neighborhood of the distance between the two end plates, an internal screwthread formed in said aperture of said other plate and a bolt which screwthreadedly engages with said screwthread, said core acting as means for transmitting pressure exerted by said bolt to said inner face of said end wall, the tube having in some regions of the tube a cross-sectional shape which has a first dimension in a first direction and a second dimension shorter than the first dimension in a second direction perpendicular to the first direction, the cross-sectional shapes of at least two of said regions of said tube having their first dimensions oriented differently and the second dimensions being but slightly larger than the corresponding dimensions of the cross-section of the core so that the tube affords a lateral support for the core against buckling of the core.

16. A reinforcing device for the prestressing by compression of a concrete element and comprising a rigid reinforcement unit having a rigid tube and two end plates respectively fixed to opposite ends of the tube, one of which plates constitutes an end wall defining a terminal transverse face of the unit, said end wall having an inner face facing the other end of the tube, whereas the other plate constitutes an apertured end wall defining a terminal transverse face of the unit with the aperture in a centre part of the other plate, and means for putting the reinforcement unit under tension, the plates defining support surfaces which extend substantially radially of an outer surface of the unit and face each other for compressing the concrete between said plates when said tube-tensioning means are rendered inoperative, said tube-tensioning means comprising a rigid metal core disposed within the tube and having a screwthreaded head portion, a screwthread in said aperture of said other plate so that said other plate constitutes a nut, the nut screwthreadedly engaging the screw-threaded head portion, said core acting as means for transmitting pressure exerted by the effect of said nut to said inner face of said end wall, the tube having in some regions of the tube a cross-sectional shape which has a first dimension in a first direction and a second dimension shorter than the first dimension in a second direction perpendicular to the first direction, the cross-sectional shapes of at least two of said regions of said tube having their first dimensions oriented differently and the second dimensions being but slightly larger than the corresponding dimension of the cross-section of the core so that the tube affords a lateral support for the core against buckling of the core.

17. A reinforcing device for the prestressing by compression of a concrete element and comprising a rigid reinforcement unit having a rigid tube and two end plates respectively fixed to opposite ends of the tube, one of which plates constitutes an end wall defining a terminal transverse face of the unit which end wall has an inner face facing the other end of the tube whereas the other plate constitutes an apertured end wall defining a terminal transverse face of the unit with the aperture in a centre part of the other plate, and means for putting the reinforcement tube under tension, the plates defining support surfaces which extend substantially radially of an outer surface of the unit and face each other for compressing the concrete between said plates when said tube-tensioning means are rendered inoperative, said tube-tensioning means comprising a rigid metal core disposed within the tube and having one end in abutting relation to said inner face of said end wall and an opposite end portion projecting outwardly slightly beyond said other plate, a clamping plate bearing against said opposite end portion of the core and comprising means defining apertures, tapped apertures formed in said other plate, and bolts screwthreadedly engaged in the tapped apertures and extending through the apertures of the clamping plate for urging the clamping plate against the core and urging said end plates apart and thereby putting the whole of the tube between the tube ends under tension, the tube having in some regions of the tube a cross-sectional shape which has a first dimension in a second direction perpendicular to the first direction, the cross-sectional shapes of at least two of said regions of said tube having their first dimensions oriented differently and the second dimensions being but slightly larger than the corresponding dimension of the cross-section of the core so that the tube affords a lateral support for the core against buckling of the core.

* * * * *